United States Patent [19]

Palmeri

[11] Patent Number: 4,674,144

[45] Date of Patent: Jun. 23, 1987

[54] PAINT APPLICATOR AND PAINT WIPING APPARATUS

[76] Inventor: Joseph Palmeri, 163-55 86th St., Howard Beach, N.Y. 11414

[21] Appl. No.: 825,393

[22] Filed: Feb. 3, 1986

[51] Int. Cl.[4] ..... B05C 17/00

[52] U.S. Cl. ..... 15/210 R; 15/259.05; 220/90

[58] Field of Search ..... 15/160, 210 R, 210 A, 15/210 B, 244 R, 244 A, 244 B, 257.05; 401/9, 10; 220/90

[56] References Cited

U.S. PATENT DOCUMENTS

| | | | |
|---|---|---|---|
| 2,625,702 | 1/1953 | Grubbs | 15/160 |
| 3,291,337 | 12/1966 | Jenkins | 220/90 |
| 3,464,079 | 9/1969 | Palmeri | 15/210 R X |
| 3,484,795 | 12/1969 | Nicolay | 15/210 R X |

FOREIGN PATENT DOCUMENTS

| | | | |
|---|---|---|---|
| 933632 | 8/1963 | United Kingdom | 15/210 R |

*Primary Examiner*—Edward L. Roberts
*Attorney, Agent, or Firm*—Helfgott & Karas

[57] ABSTRACT

A paint applicator for use on a railing and on a picket fence. The applicator is formed of an L-shaped member having a base wall and an upright wall. The upright wall integrally continues from its distal end into a projecting portion which extends in a direction away from the base wall. Paint applying material is affixed to the interior surface of the base wall, the upright wall and the projecting portion. A handle depends from the base wall in opposition to the upright wall. A point wiping apparatus is also included which includes a pair of clips insertable in diametric opposition into the rim of a paint can. A rod is received within the clips and spans the paint can. Upon extraction of the paint applicator, the excess paint is wiped off the applicator and drips back into the can.

18 Claims, 24 Drawing Figures

PAINT APPLICATOR AND PAINT WIPING APPARATUS

BACKGROUND OF THE INVENTION

This invention relates to paint applicators, and more particularly to a paint applicator useful for painting railings and picket fences, and a paint wiping apparatus for wiping the paint applicator upon extraction from a paint can.

Although there are numerous types of paint applicators, certain painting surfaces provide difficulties to painting. By way of example, iron railings are difficult to paint with standard paintbrushes or rollers. The ornamental curvatures of the railing including curvilinear sections of general S-shapes with spirals are most awkward to paint. Frequently such iron railing include closed or open circle configurations which are impossible to reach with standard rollers.

In addition to the difficulty in reaching these awkward small grooves and curved shapes, the iron railings present difficulties in that there are two perpendicular surfaces which require painting, both of which are quite small. The iron railing has the front facing surface which is normally in a common vertical plane. This surface must be painted in addition to the inside surface which forms the curves and grooves.

A somewhat similar problem is presented when trying to paint a picket fence. Typically, a picket fence construction is in the form of horizontal railings on which are attached spaced apart vertical picket strips. In painting the fence, all of the surfaces must be covered. While a roller can reach the front facing surface, it is almost impossible to use the roller for the small sides of the pickets as well as the intermediate portion of the railing between adjacent pickets. A paintbrush can be used however it is a tedious task because of the numerous surfaces that must be covered, all of which are perpendicular to each other.

An additional problem that arises with paint applicators is to wipe off the excess paint upon removal of the paint applicator from the paint can. Normally, the paint applicator is inserted into the can and after it is saturated with paint it is extracted from the can. Since normally excess paint will be dripping from the applicator, the applicator is normally wiped against the upper rim of the paint can. While this can remove some of the paint, it is quite inefficient since the paint applicator is typically flat and the rim of the paint can is curved. Therefore, an inaccurate match occurs and not all of the paint can be wiped from the applicator.

Additionally, when wiping the paint applicator against the rim of the can, a lot of the excess paint accumulates in the rim and will fill the grooves about the upper surface of the can. When replacing the cover onto the can, the paint that now sits in the grooves splashes over the outer edge of the can leaving a messy can and frequently marring the support surface on which the can has been placed.

In U.S. Pat. No. 3,464,079 there is described a paint applicator by the inventor of the present application. In that patent there is described a paint applicator having two mutually perpendicular surfaces available for painting iron railings. The two surfaces meet along a longitudinal line. Longitudinally extending from one of the sides there is a projecting finger which can be used for insertion into the grooves of the iron railings. While such paint applicator has been found useful and quite an improvement over previous paint applicators, it has been found to be somewhat awkward in actual use. Since the projecting finger extends from one edge in the same longitudinal direction as the joining line of the two surfaces, it therefore requires extraction of the paint applicator from the rail and reinsertion of the applicator in a direction perpendicular to its normal movement. As a result, there is a great amount of manipulation required in order to use the paint applicator and painting of the iron rails cannot be achieved with a continuous stroke. Additionally, while the projecting portion is useful for painting inside the curvilinear sections, it will not paint the facing surface of the rail around the curvilinear portions. Additionally, the paint applicator of the prior patent is not useful for picket fences and other difficult to paint surfaces.

SUMMARY OF THE INVENTION

Accordingly, it is an object of the present invention to provide a new and improved paint applicator which improves upon prior art applicators.

Another object of the present invention is to provide a paint applicator which is useful for painting inaccessible surfaces such as iron railings, and picket fences.

A further object of the present invention is to provide a paint applicator which can paint two mutually perpendicular surfaces including curvilinear sections with a single continuous stroke without the requirement of withdrawing and reinserting the paint applicator into the painting surface.

A further object of the present invention is to provide a paint wiping apparatus for removal of excess paint from a paint applicator upon extraction from a painting can.

A further object of the present invention is to provide a paint wiping apparatus which can be inserted into any paint can and useful for removal of excess paint from all types of painting applicators, such as paintbrushes and the like.

In accordance with the present invention, there is provided a paint applicator having a L-shaped construction including a base wall and an upright wall. The upright wall integrally continues from its distal end into a projecting portion which extends in a direction away form the base wall. The base and upright walls as well as the projecting portion have an interior and an exterior surface with paint applying material affixed to all of the interior surfaces. A handle depends from the base wall in diametric opposition to the upright wall.

In one embodiment of the invention, the projecting portion is a finger-like projection which is coplanar with the upright wall. It projects perpendicularly to the base wall and the handle is in diametric opposition to the projecting portion. In this embodiment, the paint applicator is useful for paining iron railings, including the curvilinear portion and the applicator can go around the spirals using a single stroke without having to extract and reinsert the applicator at a different orientation.

In another embodiment of the invention, the projecting portion is coextensive along the entire length of the upright wall and extends outwardly from the distal edge of the upright wall. In this way, the projecting portion is perpendicular to the upright wall and parallel to the base wall. Such projecting portion can extend from either one side or both sides, whereupon the upright wall would be provided on both sides of the base wall.

In this embodiment, the paint applicator is useful for painting a picket fence. Using a single stroke, both the front face and side edges of the picket can be painted in a single stroke. Additionally, lateral adjacent portions of the horizontal rail will also be painted using the same stroke.

The invention further contemplates a paint wiping appratus for removal of excess paint from a paint applicator. The apparatus includes a pair of spring clips which can be removably insertable into the peripheral groove at the top end of a paint can. An elongated rod has its opposing ends insertable into the spring clips so that the rod spans across the top of the paint can. Upon extraction of a paint applicator from the paint can, the applicator can be wiped against the rod to cause excess paint on the applicator to drip back into the can.

The aforementioned objects, features and advantages of the invention, will, in part, be pointed out with particularity and will, in part, become obvious from the following more detailed description of the invention taken in conjunction with the accompanying drawings, which forms an integral part thereof.

BRIEF DESCRIPTION OF THE DRAWING

In the Figures.

In the various figures of the drawings, like references designate like parts.

DESCRIPTION OF THE PREFERRED EMBODIMENT

Figure 1:
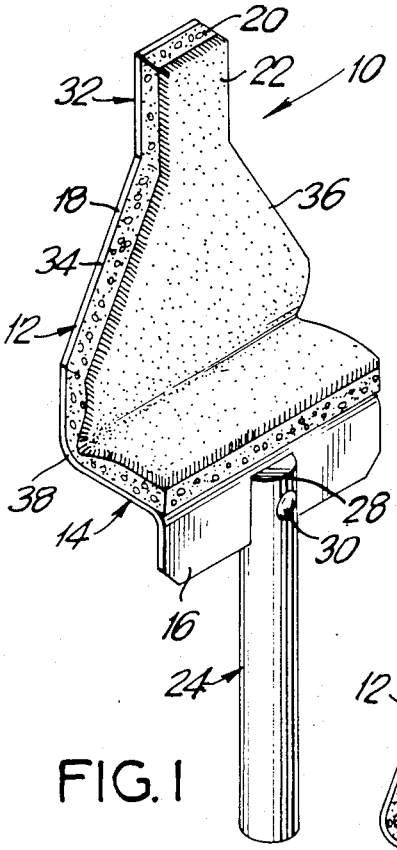
FIG. 1 is a perspective view of a paint applicator useful for painting railings and grillwork.

Referring now to FIG. 1, the paint applicator of the present invention is shown generally at 10 and includes a pair of walls 12, 14, defining a L-shaped configuration. Wall 12 forms an upright wall and is integral with wall 14 forming a base wall. The two walls continue into a downward skirt portion 16 perpendicular to the base wall 14 and parallel to the upright wall 12.

Figure 5:
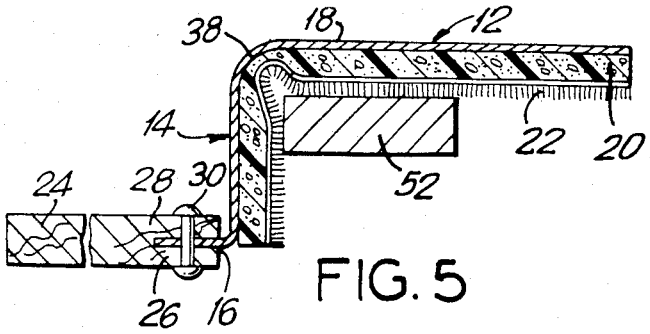
FIG. 5 is a sectional view taken along line 5—5 of FIG. 4.

As best seen in FIGS. 1 and 5, the paint applicator is formed of a back wall of metal plate 18 which is continuous throughout the upright wall 12, the base wall 14, and the skirt portion 16. Placed upon the metal place 18 and contiguous along with the upright wall 12 and the base wall 14, is a paint applicator surface. By way of example, the paint applicator surface includes a first layer of foam 20 upon which is placed nap or bristles 22. Other type of paint applicator material can also be utilized.

Depending from the skirt portion is the handle 24, typically of wooden construction. The upper portion of the handle is bifurcated so as to form the opposing sections 26, 28 with a groove therebetween which receives the skirt portion 16. A rivet or screw 30 is inserted through the bifurcated portions of the handle and through the skirt portion so as to secure the handle to the skirt portion.

The upright wall 12 continues integrally into a narrow projecting finger-like portion 32. The finger-like projection 32 is coplanar with the upright wall, perpendicular to the base wall 14, and coaxial with the handle 24.

As shown in FIG. 1, the sides of the upright wall are tapered at 34, 36 substantially along the entire length of the upright wall from its junction 38 between the base wall. The taper is approximately 45 degrees and continues until it reaches the projecting portion which then has parallel side edges.

Figure 2:
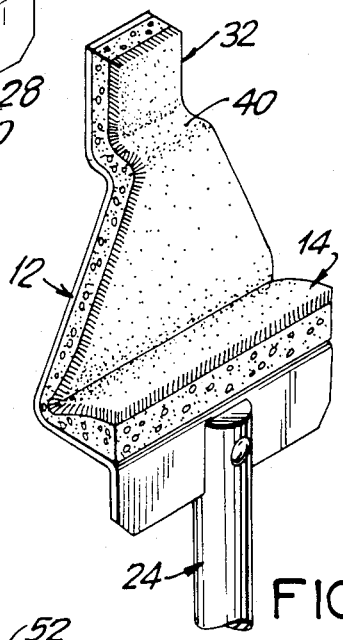
FIG. 2 is a perspective view of a modified form of the paint applicator shown in FIG. 1.

As shown in FIG. 2, intermediate the upright wall 12 and the projecting portion 32, there can be included an offset step 40 projecting rearwardly and substantially parallel to the base wall 14. The offset step 40 is integrally formed with the entire paint applicator construction so as to be continuous between the upright wall and the projecting portion.

Figure 3:
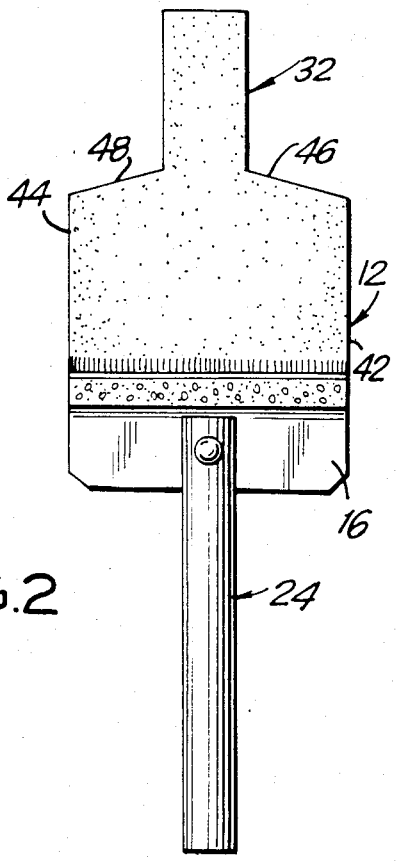
FIG. 3 is a front view of another modification of the paint applicator shown in FIG. 1.

FIG. 3 shows a slight modification wherein the upright portion 12 includes substantially parallel side walls 42, 44. There is only a slight taper 46, 48 defining adjacent shoulders between the upright portion 12 and the projecting portion 32.

Figure 4:
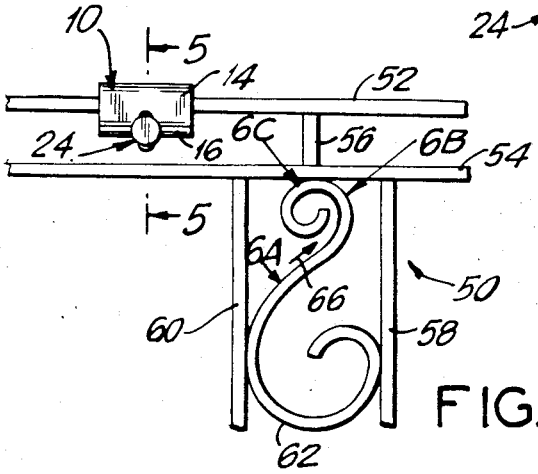
FIG. 4 is a front view of an ornamental railing including a grillwork showing the paint applicator being used to paint such railing.

The paint applicator shown in FIGS. 1–3 is useful in painting railings, especially those including curvilinear grillwork and scrollwork. As shown in FIG. 4, the railing 50 includes horizontal rail portions 52 and 54 spaced apart by a vertical rail section 56. Therebeneath are a pair of adjacent vertical rails 58, 60 on which is included a substantially S-configured grillwork 62. Normally, painting of such railing would be most difficult with a roller since the roller would not be able to reach small curves and spirals. Even with a paintbrush, painting of such surface becomes difficult. Using the paint applicator of the aforementioned U.S. patent, painting of such railing is facilitated. However, while the aforementioned paint applicator is useful in painting the horizontal portions and vertical portions, when it comes to the scrollwork, the paint applicator must be removed and reinserted in a perpendicular direction to that from which it is held. This is extremely awkward since now the handle is perpendicular to the projecting finger portion. Manipulating the projecting finger portion of the prior art patent by holding the handle perpendicular to the projecting fingers is awkward, difficult and time consuming.

With the paint applicator of the present invention the painting of such scrollwork becomes facilitated. Firstly, with respect to the horizontal and vertical straight portions of the railing, the present paint applicator can paint two mutually perpendicular surfaces. As best shown in FIG. 5, the paint applicator 10 can be seen to cover the two sides of the rail section 52. In this way, with a single stroke along the rail, both the top and front surfaces of the rail will be painted. The paint applicator can then be used to paint the opposing two surfaces of the rail with again a single stroke.

Figure 6A:
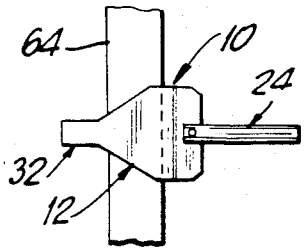
FIGS. 6A, 6B and 6C are schematic views shown at the corresponding locations indicated in FIG. 4 and showing the use of the paint applicator of FIG. 1 in painting various portions of the scrollwork on the iron railing of FIG. 4.

When it comes to the grillwork, the applicator can paint the grillwork without having the applicator extracted. The applicator can be placed along a substantially straight section of the grillwork shown as section 64 in FIG. 6A. In this case, the upright portion 12 of the paint applicator will have its full length along the grillwork with the projecting portion 32 extending beyond the grillwork.

Figure 6B:
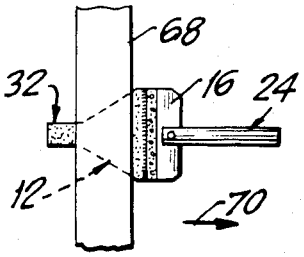

As the paint applicator is moved upward, in the direction shown by the arrow 66, a curved portion 68 of the grillwork is reached as shown in FIG. 6B. Because of the radius of curvature, the paint applicator can still be used with the same stroke by partially extracting the paint applicator in the direction shown by the arrow 70 in FIG. 6B. The side tapering portions of the upright section 12 will now be used to paint the curved portion and these will have a narrower width than the full upright portion previously used in FIG. 6A.

Figure 6C:
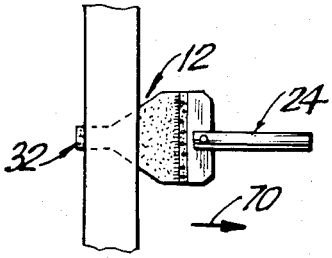

As the paint applicator continues moving around the scrollwork and reaches the narrowest portions, shown in FIG. 6C, the applicator will be almost fully extracted so that now the projecting portion 32 is used almost entirely to paint the curved portions of the railing. This narrow projecting portion 32 can continue completely around the scrollwork even to the smallest narrowest radius curvatures.

It will therefore be noted that using the present paint applicator, all of the curvilinear portions of the railing can be painted using a single stroke of the paint applicator by slightly extracting the paint applicator as it gets to the narrower curves. Complete removal and reinsertion of the paint applicator is not necessary as with the prior applicator. Furthermore, the handle is always directed towards the paint surface and it not necessary to twist the handle to make it perpendicular to the paint surface, which would be awkward as with the prior reference. Both the taper shown in FIG. 1 and FIG. 3 are useful in reaching narrower portions. The projecting portion is available for the smallest curves. With the use of the step 40 shown in FIG. 2, as the narrower portions of the curves are reached and the projecting portion 32 is used to paint the inside surface, by means of the offset arrangement with the seat, the front face of the curves can simultaneously be painted so that two surfaces are painted even at the narrower curved portions of the railing.

Figure 7:
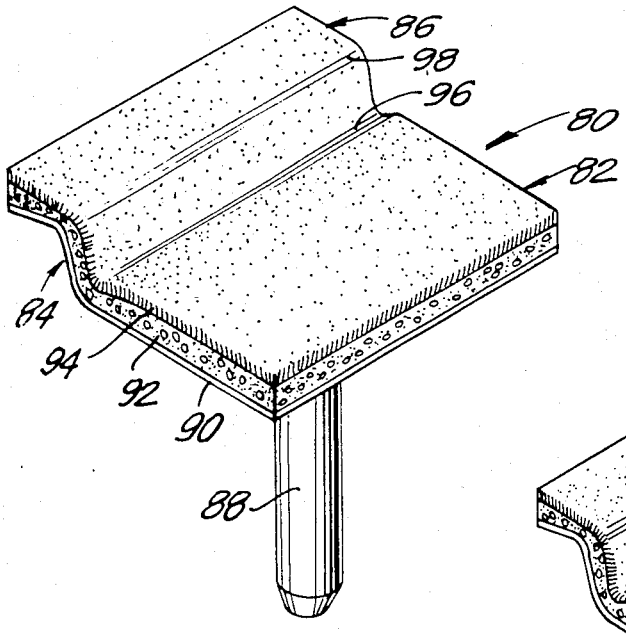
FIG. 7 is a perspective view of a paint applicator for use in painting picket fences.

Referring now to FIG. 7, there is shown another type of paint applicator 80 which is useful in painting picket fences. The applicator includes a base wall 82 with an upright wall wall 84 and a projecting portion 86. In this case, the handle 88 extends directly from the base wall 82 and perpendicularly thereto.

The walls are made of a continuous base metal layer 90 on which is placed paint applicator material. As before, the paint applicator material can include a layer of foam material 92 on which is placed nap or bristles 94. The upright layer 84 joins the base layer along a joining line 96. The upright layer is contiguous along the entire length of the base and extends perpendicularly thereto. The projecting portion 86 joins the upright wall along the joining line 98. It projects laterally outward from the upright wall and is perpendicular thereto so that it lies parallel to the basewall 82.

The handle 88 can be secured onto the base wall by various means. By way of example, a screw can be inserted through the base metal plate 90 prior to attaching the paint applicator material with the screw engaging the handle 88. Other types of securing arrangements can also be utilized.

Figure 8:
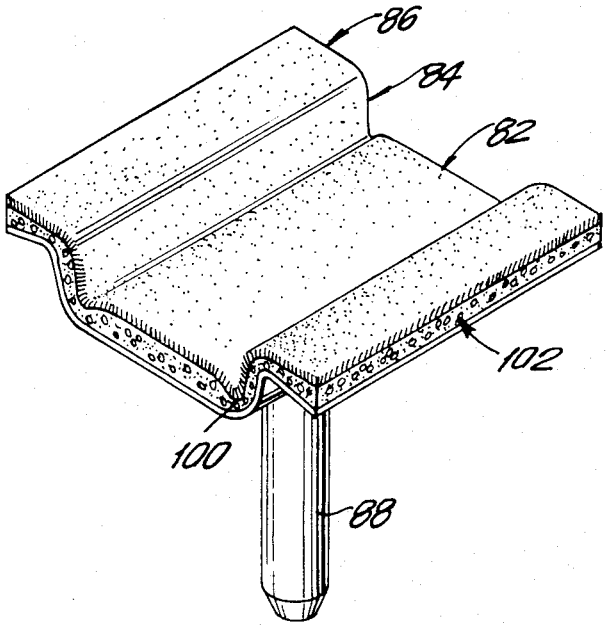
FIG. 8 is a perspective view of a modified form of the paint applicator shown in FIG. 7.

The embodiment shown in FIG. 7 has the upright wall and projecting wall extending from one lateral edge of the base wall 82. As shown in FIG. 8, a similar arrangement can be included at the other end of the base wall 82. Specifically, an upright wall 100 with a perpendicularly projecting wall 102 can also be included at the opposite end in addition to the upright wall 84 and projecting wall 86. In this manner, a substantially U-shaped arrangement is made between the base well 82 and the upright walls 84 and 100.

Figure 9:
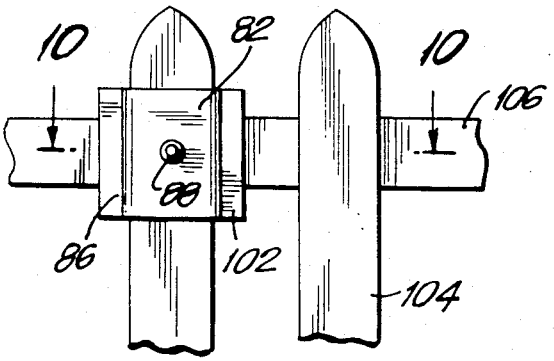
FIG. 9 is a front view of a picket fence being painted by the paint applicator shown in FIG. 8.
Figure 10:
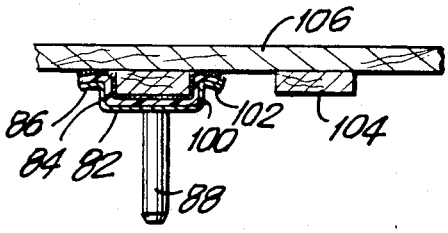
FIG. 10 is a cross sectional view taken along lines 10—10 of FIG. 9.

The picket fence is shown in FIGS. 9 and 10 and includes the vertical picket rods 104 interconnected by the horizontal railing 106. The paint applicator shown in FIG. 108 can be used to paint the picket fence with a single stroke. The base surface 82 will paint the outer face of the picket rod 104. The upright side walls 84, 100 will paint the side edges of the picket rod 104. Furthermore, the projecting lateral portions 86, 102 will be used to paint the portion of the railing 106 between adjacent rods 104.

While most picket fences are a standard size, the particular paint applicator can come in varied sizes to fit different sized picket fences should this be necessary.

Using the embodiment of FIG. 6, the applicator becomes a bit more universal so that it can fit picket fences where the pickets are of different width sizes. The applicator of FIG. 8 is designed for a single width of picket fence. However, most picket fences are of the standard width size.

It will be noted, that the paint applicator heretofore described includes a paint applicator surface on one side with a metal backing on the rear side. While the paint applicator material will hold the paint on it, the paint will typically flow off the metal back wall and will not adhere to it. When dipping the paint applicator into a paint can, paint will stick to the paint applicator surface. A slight wiping of the paint applicator surface along the upper rim of the paint can will remove some excess paint from the paint applicator surface. However, since the back surface is typically metal, the paint will not adhere to it and unless it is wiped completely dry, paint will drip from this back surface. When wiping off the paint of an applicator on the rim of a paint can, the paint applicator has a straight surface while the rim has a curved surface. As a result, the paint will only wipe off the edges of the applicator but not along the center part of the applicator. Also, any paint that wipes off the applicator will accumulate in the groove of the rim. This paint may overflow the rim and spill along the sides of the paint can making the paint can messy and difficult to touch. Also, when putting the cover onto the paint can all of the paint accumulated in the groove will squeeze out of the groove onto the paint can. This will result in the paint being all over the floor and any other surface supporting the paint can.

Figure 11:
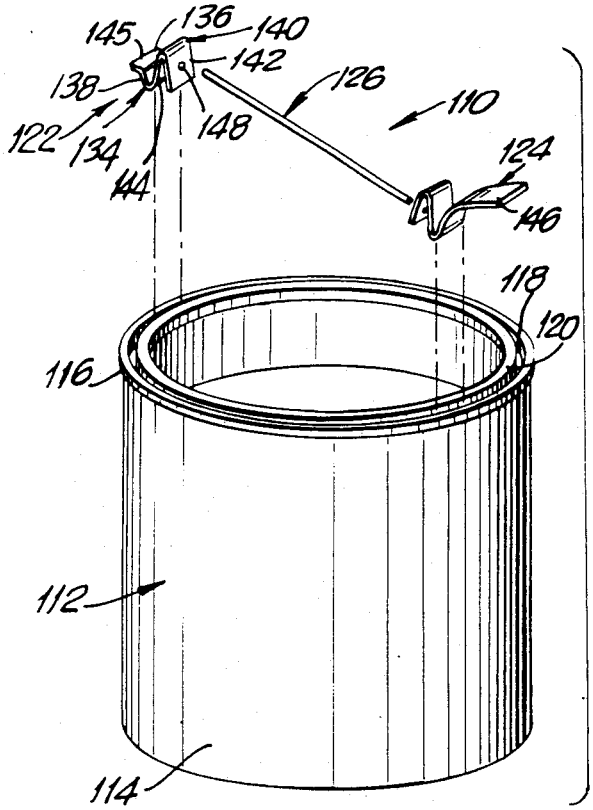
FIG. 11 is an exploded perspective view showing the paint wiping apparatus for insertion onto a paint can.

Referring now to FIG. 11, there is provided a paint wiping apparatus, shown generally at 110 which can be utilized in conjuntion with a paint can shown generally at 112. The paint can includes a cylindrical container 114 with an upper rim 116. When the cover is removed, the rim shows the presence as a groove or channel 118 between the outer rim 116 and an inner lip 120.

Figure 12:
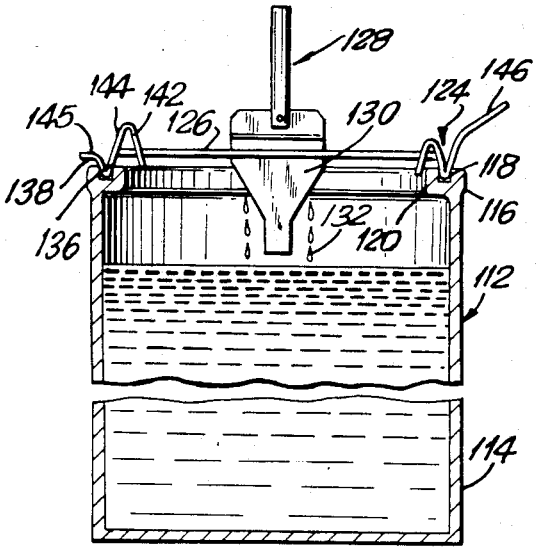
FIG. 12 is a cross sectional view taken through the paint can showing the use of the paint wiping apparatus for removal of excess paint on a paint applicator of FIG. 1.

The paint wiping apparatus of the present invention includes a pair of clips 122, 124 with an elongated rod 126. Each of the clips 122, 124 fit into the groove 118 and is securely retained in place. They receive the rod 126. By placing the clips 122, 124 at diametrically opposed positions on the can, the rod 126 will span the top of the can. As shown in FIG. 12, removal of the paint applicator 128 can be done by wiping its back surface 130 along the rod 126 as it is removed. Any excess paint contained on the surface 130 will be wiped off and will drip down into the paint can, as shown by the drops 132. Both surfaces of the paint applicator can be wiped along the rod 126. The amount of pressure applied will determine how much paint is left on the paint applicator.

The clip 122 is shown to include a substantially U-shaped portion 134 having a forward wall 136 and a rearward wall 138. The forward wall 134 continues into an inverted U-shaped portion 140 having a front portion 142 and a back portion 144. The rearward wall 138 continues into the lip 145 providing a grasping lip for insertion and removal of the clip. As clip 124 shows, the lip 145 can continue onward into a handle 146 to facilitate insertion and removal of the clips.

An aperture 148 is formed into the front wall 142 for receiving an end of the rod 126.

Clip 124 is substantially identical to the clip 122. Prior to insertion of the clips 122, 124 into the groove 118, the rod 126 is inserted into the holes 148 in the clips. The clips are then inserted into the grooves 118, as shown in FIG. 12. The walls 144 serve as a stop for insertion of the rods 126.

With the rod inserted into the two clips, the clips can then be secured into the groove 118 and held in place by having the U-shaped portion 134 squeezed together by means of the opposing walls 116, 120 of the grooves.

Figure 13:
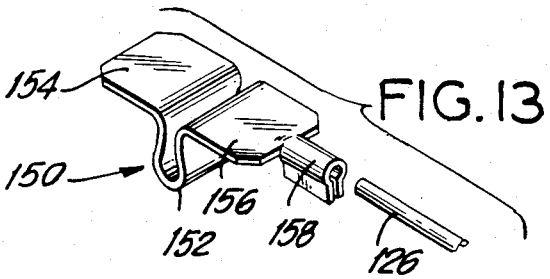
FIG. 13 is an exploded perspective view of another clip and rod arrangement for use as part of the paint wiping apparatus.

Various types of clip arrangements can be formed in order to retain the rod positioned across the paint can. As shown in FIG. 13, a clip 150 is shown having a U-portion 152. A laterally extending rearward section 154 is provided as a handle. A forward portion 156 continues into a U-shaped channel 158 which receives the rod 126.

Figure 14:
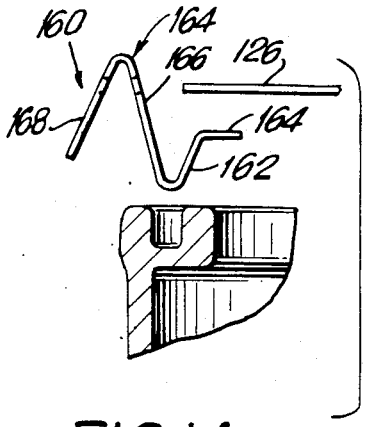
FIG. 14 is an exploded view showing yet a further clip for insertion into a paint can as part of the paint wiping apparatus.

FIG. 14 shows yet a further type of clip 160. Again, there is provided a U-shaped portion 162 which fits into the groove. The front wall extends into the forward shelf 164. The rear wall, however, continues into an inverted U-shaped portion 164. The inverted U-shaped portion includes the front wall 166 and the rear wall 168. An aperture would be formed through both the walls 166 and 168. The inverted U-shaped portion 164 projects above the came and rearwardly thereof.

Figure 15A:
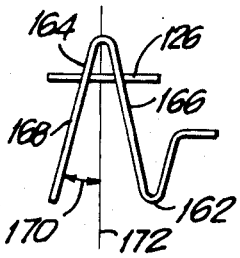
FIGS. 15A, 15B and 15C schematically show the operational use of the clip shown in FIG. 14 for receiving the rod and for removal of the rod in use of the paint wiping apparatus.
Figure 15B:
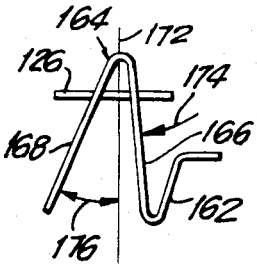
Figure 15C:
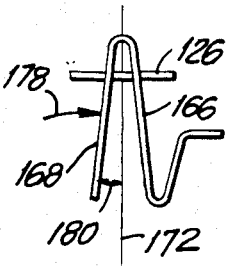

As shown in FIGS. 15A–15C, the type of clip 160 shown in FIG. 114 is a locking clip. In this way, the rod can extend beyond the clips. This type of arrangements permits use of the rods and clip for all sizes of paint cans. The length of the rod can be adjusted within the clips so that it spans whatever size paint can is utilized. Furthermore, the clips will lock onto the rod.

As shown in 15A, initially, in the unused position, the U-shaped portion 162 and the inverted U-shaped portion 164 are provided so that there is a given angle 170 between the rear wall 168 and a vertical 172. In this relaxed position, the rod 126 can be inserted into the apertures both into the forward wall 166 and the rear wall 168 and will easily slide through the walls.

FIG. 15B shows the situation where the U-shaped portion 162 is squeezed into the channel in the paint can. By doing so, the clip is pressed inwardly, as shown by the arrow 174. Pushing against the wall 166, causes the wall 168 to move outwardly so that the angle between the wall 168 and the vertical, now shown by the spacing 176, is greater than the previous spacing 170. By moving the wall 168 outwardly, the rim of the aperture in the wall 168 will bite into the rod 126 and will lock the rod in place.

Accordingly, initially in preparing the rod and clips, the rod is slidably inserted into the clips and positioned proximately the width of the can. One of the clips is then inserted into the rim. Once it is inserted, it will lock onto the rod, as shown in FIG. 15B. The other clip can then be slid along the rod until it is oriented above the diametrically opposite side of the can. That clip is then locked into place in the groove and will bite onto the rod.

In this manner, the clips can be used for all sizes of cans of paint and only one paint wiping apparatus need be applied for universal size of all cans.

As shown in FIG. 15C, when it is desired to release the rod 126, all that is needed is to press onto the wall 168, as shown by the arrow 178. This will reduce the angle 180 between the wall 168 and the vertical 172. The angle will then be substantially the same as the angle that the wall 166 is making with the vertical. This will align the apertures in the walls 166 and 168 so as to again release the rod 126 so that it can be slid of the clips. Once the rod is removed the clips can be extracted from the grooves.

Figure 16:
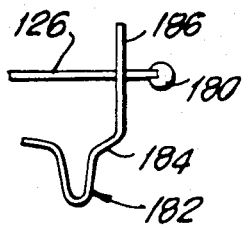
FIG. 16 shows a rod with a stop in conjunction with another type of clip of the paint wiping apparatus.

As shown in FIG. 16, the rod 126 can include a ball 180 at one end which will prevent it from sliding out of the clip. The clip shown in FIG. 16 has a slight variation from the previous embodiments. Again, there is provided a U-shaped channel 182 for fitting into the groove in the can. In this case, the rear wall continues into a dog-leg portion 184 and then projects upwardly into the vertical arm 186. The vertical arm has an aperture in which the rod 126 can fit.

Figure 17A:
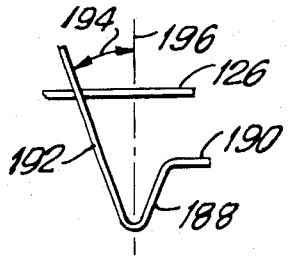
FIGS. 17A and 17B show the use of yet a further type of clip arrangement.
Figure 17B:
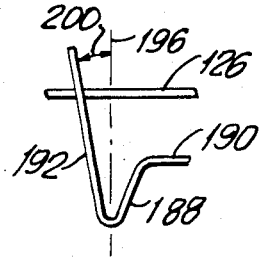

FIGS. 17A and 17B show yet a further type of a clip. The U-shaped portion 188 will fit into the groove. A forward lip 190 is provided which would fit over the rim. The rear wall extends upwardly into the extended arm 192 and includes an aperture for receiving the rod 126.

In the relaxed position shown in FIG. 17A, there is a substantially large angle 194 between the arm 192 and a vertical 196. The rod 126 can easily slide into the aperture in the relaxed position. As shown in FIG. 17B, once the U-shaped portion 188 is inserted, it squeezes together the two walls so as to bring the arm 192 closer to the vertical 196 as shown by the arrow 200. By moving the arm 192 closer, it causes the rim around the aperture to bite into the rod 136 grasping it in place.

With the embodiment shown in FIGS. 17A and 17B, again a single paint wiping apparatus can be utilized for all sized cans.

Figure 18:
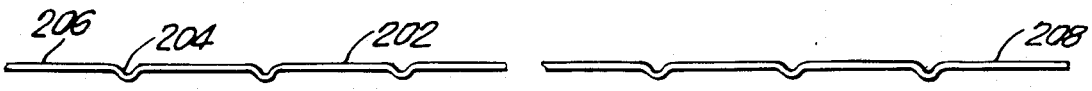
FIG. 18 shows a different type of rod having indents for establishing different lengths for varies paint can sizes.

FIG. 18 shows a rod 202 which includes U-shaped indents 204 spaced from either end 206, 208. These indents can be used to position the rod for various sized cans. Since there are generally a fixed number of cans such as a pint can, a quart, and a gallon, the indents 204 can be positioned for these three sizes. These indents would fit into the apertures in the clips that would be utilized to facilitate positioning of the rod for the various paint size cans.

Figure 19:
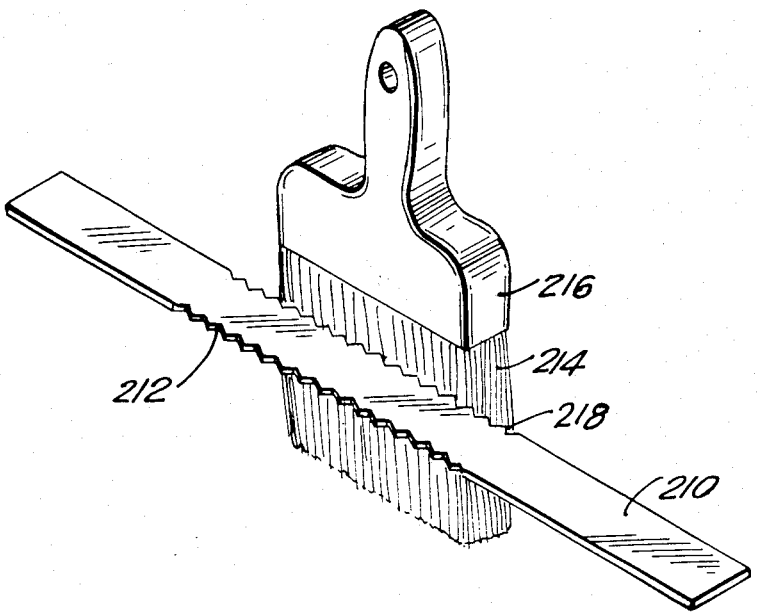
FIG. 19 is a perspective view showing a flat strip in place of the rod for use with a paint brush type of paint applicator.

Instead of a simple rod, as shown in FIG. 19, a flat strip 210 can be utilized as the wiper blade. The blade 210 can fit into elongated slots provided in the clips as opposing ends of the can. By making at least one edge of the blade 210 serrated as shown in 212, that edge can be used to wipe against the long hairs 214 of a standard paintbrush 216 making the other side serrated at 218 facilitates use of the blade 212.

Accordingly, the wiping apparatus need not only be utilized with the paint applicator heretofore shown in FIGS. 1–3 and FIGS. 7–8 but it can also be utilized with a standard paintbrush, as well as other types of applicators.

There has been disclosed heretofore the best embodiment of the invention presently contemplated. However, it is to be understood that various changes and modifications may be made thereto without departing from the spirit of the invention.

What I claim is:

1. A paint applicator comprising: an L-shaped member including a base wall and an upright wall, said upright wall integrally continuing into a projecting portion extending in a direction away from said base wall, said walls and projecting portion having an interior and an exterior surface, paint applying material affixed to all said interior surfaces, and a handle depending from the base wall in diametric opposition to the upright wall, wherein said projecting portion is a finger-like projection coplanar with the upright wall and perpendicular to the base wall, and said handle is in diametric opposition to said projecting portion.

2. A paint applicator as in claim 1, and comprising inwardly tapered sides interconnecting from the upright wall to the projecting portion.

3. A paint applicator as in claim 2, wherein said taper is less than 45 degrees with a vertical axis.

4. A paint applicator as in claim 1, and further comprising a skirt portion depending from the base wall, said handle depending from the skirt portion.

5. A paint applicator as in claim 4, wherein the handle comprises a rod having a bifurcated medial end for receiving said skirt portion therebetween, and connecting means for coupling said rod to said skirt portion.

6. A paint applicator as in claim 4, wherein said base wall, said upright wall, said projecting portion, and said skirt portion are integrally formed of a unitary construction.

7. A paint applicator as in claim 6, wherein all said exterior surfaces are formed of an exposed metal layer.

8. A paint applicator as in claim 7, wherein said paint appying material comprise a layer of foam material on said metal layer and nap material on said foam material.

9. A paint applicator as in claim 1, and further comprising an offset step portion between said upright wall and said projecting portion, said step portion being substantially parallel to said base wall.

10. The combination of a paint applicator as in claim 1, and a paint wiper, said paint wiper comprising a pair of clips diametrically insertable into the peripheral groove at the top end of a paint can, and an elongated rod whose opposing ends are receivable in said clips, to thereby span the paint can, whereby upon extraction from the paint can, the applicator can be wiped against the rod to cause the excess paint on the applicator to drip back into the can.

11. The combination as in claim 10, wherein the clips are formed of a spring material and are resiliently held secure in the groove.

12. The combination as in claim 11, and comprising release means integrally formed with the clips to facilitate removal from the groove.

13. A paint applicator comprising: an L-shaped member including a base wall and an upright wall, said upright wall integrally continuing into a projecting portion extending in a direction away from said base wall, said walls and projecting portion having an interior and an exterior surface, paint applying material affixed to all said interior surfaces, and a handle depending from the base wall in diametric opposition to the upright wall, wherein said projecting portion is coextensive along the entire length of the upright wall, extends outwardly from the distal edge of the upright wall, and perpendicularly to the upright wall and parallel to the base wall.

14. A paint applicator as in claim 13, and comprising a further upright wall extending from the opposing side of said base wall to define a U-shaped member, and a further projecting portion correspondingly projecting from said further upright wall.

15. A paint applicator as in claim 13, wherein said handle depends from the proximate center of said base wall.

16. The combination of a paint applicator as in claim 13, and a paint wiper, said paint wiper comprising a pair of clips diametrically insertable into the peripheral groove at the top end of a paint can, and an elongated rod whose opposing ends are receivable in said clips, to thereby span the paint can, whereby upon extraction from the paint can, the applicator can be wiped against the rod to cause the excess paint on the applicator to drip back into the can.

17. The combination as in claim 16, wherein the clips are formed of a spring material and are resiliently held secure in the groove.

18. The combination as in claim 17, and comprising release means integrally formed with the clips to facilitate removal from the groove.

* * * * *